US006509308B1

(12) United States Patent
De Buzzaccarini et al.

(10) Patent No.: US 6,509,308 B1
(45) Date of Patent: Jan. 21, 2003

(54) BLEACHING COMPOSITIONS

(75) Inventors: Francesco De Buzzaccarini, Breendonk (BE); Michael Eugene Burns, Hamilton, OH (US); Pierre Antoine Dresco, Rome (IT); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,188

(22) PCT Filed: Nov. 10, 1999

(86) PCT No.: PCT/US99/06606

§ 371 (c)(1),
(2), (4) Date: May 7, 2001

(87) PCT Pub. No.: WO00/27960

PCT Pub. Date: May 18, 2000

(30) Foreign Application Priority Data

Oct. 11, 1998 (WO) ..... PCT/US98/23989

(51) Int. Cl.[7] ..... C11D 1/29; C11D 3/39; C11D 3/395

(52) U.S. Cl. ..... 510/372; 510/303; 510/310; 510/313; 510/318; 510/376

(58) Field of Search ..... 510/303, 310, 510/313, 318, 372, 376

(56) References Cited

U.S. PATENT DOCUMENTS

| | | | | | |
|---|---|---|---|---|---|
| 4,992,194 | A | * | 2/1991 | Liberati et al. | 252/99 |
| 5,503,765 | A | * | 4/1996 | Schepers et al. | 252/95 |
| 5,712,239 | A | * | 1/1998 | Knowlton et al. | 510/372 |
| 5,792,385 | A | | 8/1998 | Scheuing et al. | |
| 6,096,098 | A | * | 8/2000 | Miracle et al. | 8/11 |
| 6,117,357 | A | * | 9/2000 | Kott et al. | 252/186.38 |
| 6,200,944 | B1 | * | 3/2001 | Dovey et al. | 510/313 |
| 6,306,812 | B1 | * | 10/2001 | Perkins et al. | 510/310 |
| 6,365,564 | B1 | * | 4/2002 | Kott et al. | 510/376 |

FOREIGN PATENT DOCUMENTS

| | | | |
|---|---|---|---|
| EP | 0 435 379 | | 7/1991 |
| EP | 435379 | * | 7/1991 |
| EP | 0 442 549 | | 8/1991 |
| EP | 442549 | * | 8/1991 |
| EP | 0 610 010 | | 8/1994 |
| EP | 610010 | * | 8/1994 |
| EP | 0 890 635 | | 1/1999 |
| EP | 890635 | * | 1/1999 |
| GB | 2 279 660 | | 1/1995 |
| GB | 2.279660 | * | 1/1995 |
| WO | WO 94 13776 | | 6/1994 |
| WO | WO 94/13776 | * | 6/1994 |

* cited by examiner

*Primary Examiner*—Gregory Delcotto
(74) *Attorney, Agent, or Firm*—Richard S. Echler, Sr.; Kim W. Zerby; Steven W. Miller

(57) ABSTRACT

The present invention relates to a bleaching comprising a pre-formed peroxycarboxylic acid having solubility in an aqueous composition of from 50 ppm to 800 ppm. These compositions are suitable to deliver improved bleaching performance whilst also being safe to color and fabric. Furthermore the compositions herein are also chemically and physically stable upon prolonged periods of storage time.

2 Claims, No Drawings

BLEACHING COMPOSITIONS

TECHNICAL FIELD

The present invention relates to a bleaching compositions which can be used to bleach various surfaces including but not limited to, hard-surfaces as well as fabrics, clothes, carpets and the like.

BACKGROUND OF THE INVENTION

Commonly encountered liquid aqueous bleaching compositions suitable for the bleaching of stains on fabrics and hard-surfaces are based on halogen bleaches, especially hypochlorite bleaches. Halogen bleaches are extremely effective bleaching agents, however they also present a number of drawbacks which can sometimes dissuade a consumer from choosing the halogen-containing product. For example halogen bleaches, especially chlorine bleaches, emit a pungent odour during and after use (e.g., on consumer hands and/or surfaces treated therewith) which some consumer find disagreeable.

Furthermore, it is known in the art halogen bleach-containing compositions (typically hypochlorite) are relatively aggressive to fabrics and may cause damage when used in relatively high concentration and/or repeated usage. In particular the consumer may perceive damage to the fabric itself (e.g. loss of tensile strength) or damage to the colour intensity of the fabric. While colour and fabric damage may be minimised by employing milder oxygen bleaches such as hydrogen peroxide, the bleach performance characteristics of such peroxygen bleaches are much less desirable than those of the halogen bleaching agents. Therefore, liquid aqueous activated peroxygen bleach-containing compositions have been developed containing activators, i.e., compounds which enhance peroxygen bleaching performance. However these bleaches do not perform as well as hypohalite bleaches in stain removal.

It is thus an object of the present invention to provide a bleaching composition which not only delivers effective bleaching performance, when used in laundry applications and/or in any household application (e.g. bleaching/disinfecting of hard-surfaces), but is also safe to the surfaces treated, e.g. to fabrics per se and/or colours of fabrics.

Also another problem encountered when formulating bleaching compositions, is their tendency to chemical and physical instability upon prolonged periods of storage. Thus it is thus a further object of the present invention to provide bleaching composition delivering effective bleaching performance which are chemically and physically stable upon prolonged periods of storage.

The compositions according to the present invention may be useful in any laundry application, e.g., as a laundry detergent or a laundry additive, and when used as a laundry pre-treater. A particular advantage of the compositions of the present invention is that they are suitable for the bleaching of different types of fabrics including natural fabrics, (e.g., fabrics made of cotton, and linen), synthetic fabrics such as those made of polymeric fibres of synthetic origin (e.g., polyamide-elasthane) as well as those made of both natural and synthetic fibres. For example, the bleaching compositions of the present invention herein may be used on synthetic fabrics despite a standing prejudice against using bleaches on synthetic fabrics, as evidenced by warnings on labels of clothes and commercially available bleaching compositions like hypochlorite-containing compositions.

Another advantage of the bleaching compositions according to the present invention is that they can be used in a variety of conditions, i.e., in hard and soft water as well as when used neat or diluted. More particularly, it has been found that the liquid aqueous compositions of the present invention find a preferred application when used in their diluted form in any application and especially in any conventional laundry application. Indeed, upon dilution (typically at a dilution level of 20 ml/L or more (composition:water)) the compositions of the present invention become less acidic, e.g., from a pH of about 1.5 to about 6.5 or more.

The compositions according to the present invention although delivering effective bleaching performance in their neat form surprisingly exhibit further enhanced bleaching performance in their diluted form. Actually, this "pH jump" effect allows to formulate acidic liquid aqueous compositions (i.e. pH below 7, preferably below 3 and more preferably below 2) which are physically and chemically stable upon prolonged periods of storage and which deliver outstanding bleaching performance under diluted usage conditions.

Yet another advantage of the compositions of the present invention is that they exhibit also effective stain removal performance on various stains including enzymatic stains and/or greasy stains.

SUMMARY OF THE INVENTION

According to the present invention there is provided an aqueous bleaching composition comprising a preformed peroxycarboxylic acid wherein the solubility of the peroxycarboxylic acid in the aqueous composition is from 50 ppm to 1000 ppm. In a preferred aspect the present invention provides that the peroxycarboxylic acid is phthalimido perhexanoic acid (PAP).

In another preferred aspect the peroxycarboxylic acid has a mean average particle size of less than 100 microns.

The present invention further encompasses processes of bleaching a surface with a composition according to the present invention.

DETAILED DESCRIPTION OF THE INVENTION

Aqueous Bleaching Composition

The compositions according to the present invention are aqueous. Thus the composition preferably has a water content of from 10% to 99%, more preferably from 30% to 95%, more preferably 40% to 90% by weight of the composition.

Where the composition according to the present invention is liquid is preferably has a pH of below 7. Preferably, the pH of the compositions according to the present invention is from 0.1 to 6.5, more preferably from 0.5 to 5, even more preferably from 2 to 4. Formulating the compositions according to the present invention in the acidic pH range is critical to the chemical stability of the compositions according to the present invention. The pH of the composition is preferably below the pKa of the peracid used. It is believed that the acidic pH controls/limits the formation of highly reactive species which are unstable in acidic medium upon storage, and thus contributes to the stability of the compositions for prolonged periods of storage.

The pH of the compositions may be adjusted by any acid or alkaline species known to those skilled in the art. Examples of acidic species suitable for use herein are organic acids, such as citric acid and inorganic acids, such as sulphuric acid, sulphonic acid and/or metanesulphonic acid. Examples of alkaline species are sodium hydroxide, potassium hydroxide and/or sodium carbonate.

The bleaching performance of the present composition may be evaluated by the following test methods on various type of bleachable stains.

A suitable test method for evaluating the bleaching performance on a soiled fabric under diluted conditions is the following: A composition according to the present invention is diluted with water typically at a dilution level of 1 to 100 ml/L, preferably 20 ml/L (composition:water), then the soiled fabrics are soaked in it for 20 minutes to 6 hours and then rinsed. Alternatively the bleaching composition can be used in a washing machine at a dilution level of typically at a dilution level of 1 to 100 ml/L (composition:water). In the washing machine the soiled fabrics are washed at a temperature of from 30° to 70° C. for 10 to 100 minutes and then rinsed. The reference composition in this comparative test undergoes the same treatment. Soiled fabrics/swatches with for example tea, coffee and the like may be commercially available from E.M.C. Co. Inc..

The bleaching performance is then evaluated by comparing side by side the soiled fabrics treated with a composition of the present invention with those treated with the reference, e.g., the same composition but comprising no bleach or a different bleach. A visual grading may be used to assign difference in panel units (psu) in a range from 0 to 4.

An advantage of the compositions of the present invention is that they are physically and chemically stable upon prolonged periods of storage.

Chemical stability of the compositions herein may be evaluated by measuring the concentration of available oxygen at given storage time after having manufactured the compositions. By "chemically stable", it is meant herein that the compositions of the present invention comprising a peracid do not undergo more than 15% AvO loss, in one month at 25° C. and preferably not more than 10%.

The loss of available oxygen (AvO) of a peracid-containing composition over time can be measured by titration with potassium permanganate after reduction with a solution containing ammonium ferrous sulphate. This stability test method is well known in the art and is reported, for example, on the technical information sheet of Curox$^R$ commercially available from Interox. Alternatively persulfate concentration can also be measured using a chromatography method described in the literature for peracids (F. Di Furia et al., Gas-liquid Chromatography Method for Determination of Peracids, Analyst, Vol 113, May 1988, p 793–795).

By "physically stable", it is meant herein that no phase separation occurs in the compositions according to the present invention for a period of 7 days at 50° C.

Pre-formed Peroxy Carboxylic Acid

The bleaching composition of the present invention comprises a pre-formed peroxycarboxylic acid (hereinafter referred to as peracid). In a preferred embodiment of the present invention the peracid has the general formula

X—R—C(O)OOH wherein R is a linear or branched alkyl chain having at least 1 carbon atom and X is hydrogen or a substituent group selected from the group consisting of alkyl, especially alkyl chains of from 1 to 24 carbon atoms, aryl, halogen, ester, ether, amine, amide, substituted phthalic amino, imide, hydroxide, sulphide, sulphate, sulphonate, carboxylic, heterocyclic, nitrate, aldehyde, phosphonate, phosphonic or mixtures thereof.

More particularly the R group preferably comprises from 2 to 24 carbon atoms. Alternatively, the R group may be a branched alkyl chain comprising one or more side chains which comprise substituent groups selected from the group consisting of aryl, halogen, ester, ether, amine, amide, substituted phthalic amino, imide, hydroxide, sulphide, sulphate, sulphonate, carboxylic, heterocyclic, nitrate, aldehyde, ketone or mixtures thereof.

A preferred per acid according to the present invention has the formula:

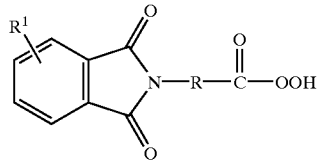

wherein R is $C_1$–$C_{20}$ alkylene; each $R^1$ is hydrogen, alkyl, hydroxyl, nitro, halogen, amine, ammonium, cyano, carboxy, sulphate, sulphonate, and mixtures thereof.

In a preferred aspect of the present invention R is an alkyl group having from 3 to 12 carbon atoms, more preferably from 5 to 9 carbon atoms. Preferred substituent groups A, B, C and D are linear or branched alkyl groups having from 1 to 5 carbon atoms, but more preferably hydrogen.

Preferred peracids are selected from the group consisting of phthaloyl amido peroxy hexanoic acid (also known as phthaloyl amido-peroxy caproic acid), phthaloyl amido peroxy heptanoic acid, phthaloyl amido peroxy octanoic acid, phthaloyl amido peroxy nonanoic acid, phthaloyl amido peroxy decanoic acid and mixtures thereof.

One aspect of the present invention relates to a substantially water-insoluble preformed peracid having the formula:

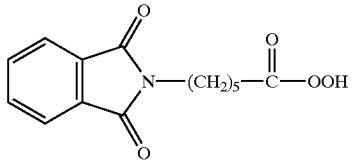

which is known as 6-phthalimido peroxycaproic acid (PAP) and available as Euroco® in the form of a wetcake ex Ausimont.

The peracids used herein have solubility in aqueous composition of from to more preferably from 50 ppm to 1000 ppm most preferably from 50 ppm to 800 ppm solubility is measured at 20 C.

In order to measure the PAP solubility, the compositions containing preformed peracid were centrifuged at 2000 rpm for 20 minutes to achieve separation of the solid PAP layer. The clear upper layer of the sample was separated and analysed for the presence of solubilized peroxides by using the AvO titration method.

In a particularly preferred embodiment the compositions of the present invention are substantially free of surfactant and/or hydrotrope and/or the carboxylic acid corresponding to the peroxycarboxylic acid. It has been found that such compositions have improved chemical stability versus compositions containing the above components.

In a particularly preferred embodiment of the present invention the peracid has mean average particle size of less than 100 microns, more preferably less than 80 microns, even more preferably less than 60 microns. Most preferably the PAP has mean average particle size of between 20 and 50 microns.

The PAP is preferably present at a level of from 0.1% to 20%, more preferably from 1% to 10%, most preferably from 2% to 4%. Alternatively, PAP may be present at a much higher level of for example 10% to 40%, more preferably from 15% to 30%, most preferably from 15% to 25%.

Optional Ingredients

The compositions herein may further comprise a variety of other optional ingredients such as surfactants, suspending agent, chelating agents, radical scavengers, antioxidants, stabilisers, builders, soil suspending polymer, polymeric soil release agents, pH control agents, dye transfer inhibitor, solvents, suds controlling agents, suds booster, brighteners, perfumes, pigments, dyes and the like.

Surfactant

The compositions of the present invention may comprise a surfactant as a preferred but optional ingredient. Where present a surfactant is selected form the group consisting of nonionic surfactants, anionic surfactants, cationic surfactants, zwitterionic surfactants and/or amphoteric surfactants.

Preferred anionic surfactants for use in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of C10–16, more preferably C10–14 are preferred for lower wash temperatures (e.g. below approx. 50° C.) and C16–18 alkyl chains are preferred for higher wash temperatures (e.g. above approx. 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other particularly suitable anionic surfactants for use herein are alkyl sulphonates including water-soluble salts or acids of the formula $RSO_3M$ wherein R is a $C_6$–$C_{22}$ linear or branched, saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{22}$ linear or branched saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

The alkylsulfonates and alkyl aryl sulphonates for use herein include primary and secondary alkylsulfonates and primary and secondary alkyl aryl sulphonates. By "secondary C6–C22 alkyl or C6–C22 alkyl aryl sulphonates", it is meant herein that in the formula as defined above, the SO3M or aryl-SO3M group is linked to a carbon atom of the alkyl chain being placed between two other carbons of the said alkyl chain (secondary carbon atom).

For example C14–C16 alkyl sulphonate salt is commercially available under the name Hostapur ® SAS from Hoechst and C8-alkylsulphonate sodium salt is commercially available under the name Witconate NAS 8® from Witco SA. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Other anionic surfactants useful for detersive purposes can also be used herein. These can include salts (including, for example, sodium, potassium, ammonium, and substituted ammonium salts such as mono-, di- and triethanolamine salts) of soap, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14}$–$C_{16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO\text{-}M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other particularly suitable anionic surfactants for use herein are alkyl carboxylates and alkyl alkoxycarboxylates having from 4 to 24 carbon atoms in the alkyl chain, preferably from 8 to 18 and more preferably from 8 to 16, wherein the alkoxy is propoxy and/or ethoxy and preferably is ethoxy at an alkoxylation degree of from 0.5 to 20, preferably from 5 to 15. Preferred alkylalkoxycarboxylate for use herein is sodium laureth 11 carboxylate (i.e., $RO(C_2H_4O)_{10}$—$CH_2COONa$, with R=C12–C14) commercially available under the name Akyposoft® 100NV from Kao Chemical Gbmh.

Suitable amphoteric surfactants for use herein include amine oxides having the following formula $R_1R_2R_3NO$ wherein each of R1, R2 and R3 is independently a saturated substituted or unsubstituted, linear or branched hydrocarbon chain of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated, substituted or unsubstituted linear or branched hydrocarbon chain. Suitable amine oxides for use herein are for instance natural blend C8–C10 amine oxides as well as C12–C16 amine oxides commercially available from Hoechst.

Suitable zwitterionic surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic surfactants to be used herein is:

$$R_1\text{-}N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R^a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is a $C_1$–$C_4$ carboxylic acid group or C1–C4 sulfonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyidimethyl betaines include coconut-dimethyl betaine, lauryl dimethyl betaine, decyl dimethyl betaine, 2-(N-decyl-N,N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

Suitable cationic surfactants for use herein include derivatives of quaternary ammonium, phosphonium, imidazolium and sulfonium compounds. Preferred cationic surfactants for use herein are quaternary ammonium compounds wherein one or two of the hydrocarbon groups linked to nitrogen are a saturated, linear or branched alkyl group of 6 to 30 carbon atoms, preferably of 10 to 25 carbon atoms, and more preferably of 12 to 20 carbon atoms, and wherein the other hydrocarbon groups (i.e. three when one hydrocarbon group is a long chain hydrocarbon group as mentioned hereinbefore or two when two hydrocarbon groups are long chain hydrocarbon groups as mentioned hereinbefore) linked to the nitrogen are independently substituted or unsubstituted, linear or branched, alkyl chain of from 1 to 4 carbon atoms, preferably of from 1 to 3 carbon atoms, and more preferably are methyl groups. Preferred quaternary ammonium compounds suitable for use herein are non-chloride/non halogen quaternary ammonium compounds. The counterion used in said quaternary ammonium compounds are compatible with any persulfate salt and are selected from the group of methyl sulfate, or methylsulfonate, and the like.

Particularly preferred for use in the compositions of the present invention are trimethyl quaternary ammonium compounds like myristyl trimethylsulfate, cetyl trimethylsulfate and/or tallow trimethylsulfate. Such trimethyl quaternary ammonium compounds are commercially available from Hoechst, or from Albright & Wilson under the trade name EMPIGEN CM®.

Amongst the nonionic surfactants, alkoxylated nonionic surfactants and especially ethoxylated nonionic surfactants are suitable for use herein. Particularly preferred nonionic surfactants for use herein are the capped alkoxylated nonionic surfactants as they have improved stability to the persulfate salts.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{15}$ alkyl group;

wherein $R_2$ is a $C_1$–$C_1$ linear or branched alkyl group, preferably a $C_2$–$C_{10}$ linear or branched alkyl group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Particularly preferred surfactants are those selected from the group consisting of alkyl sulphate, alkyl ethoxy sulphate, alkyl sulphonate, alkyl benzene sulphonate, alkyl carboxylate, alkyl ethoxy carboxylate and mixtures thereof.

The compositions according to the present invention comprise surfactant at a level of from 0.01% to less than 5%, more preferably at a level of from 0.1% to 4% and most preferably from 0.2% to 3% by weight of the composition.

Suspending Agent

The composition of the present invention may preferably comprise a suspending agent. A suspending agent is an ingredient which is specifically added to the composition of the present invention to suspend a solid particulate ingredient of the composition. With regard to the present invention, a suspending agent is particularly useful for suspending the PAP.

Suitable suspending agents are those known in the art. Examples of suspending agents include gum-type polymers (e.g. xanthan gum), polyvinyl alcohol and derivatives thereof, cellulose and derivatives thereof and polycarboxylate polymers.

In a particularly preferred embodiment of the present invention, the suspending agent is selected from a gum-type polymer or a polycarboxylate polymer.

The gum-type polymer may be selected from the group consisting of polysaccharide hydrocolloids, xanthan gum, guar gum, succinoglucan gum, Cellulose, derivatives of any of the above and mixtures thereof. In a preferred aspect of the present invention the gum-type polymer is a xanthan gum or derivative thereof.

The gum-type polymer is preferably present at a level of from 0.01% to 10%, most preferably from 0.1% to 3%.

The polycarobxylate polymer can be a homo or copolymer of monomer units selected from acrylic acid, methacrylic acid, maleic acid, malic acid, maleic anhydride. Preferred polycarboxylate polymers are Carbopol from BF Goodrich. Suitable polymers have molecular weight in the range of from 10000 to 100 000 000 most preferably 1000 000 to 10 000 000.

The cross-linked polycarboxylate polymer is preferably present at a level of from 0.01% to 2% more preferably from 0.01% to 1%, most preferably from 0.1% to 0.8%.

In an alternative embodiment the suspending agent comprises a combination of at least two polymers. In this embodiment the first polymer is a gum-type polymer and the second is a cross-linked polycarboxylate polymer. The composition may additionally comprise further polymers.

The ratio of gum-type polymer to cross-linked polycarboxylate polymer is from 100:1 to 1:100, most preferably from 1:10 to 10:1.

Chelating Agents

The compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

The presence of chelating agents contribute to further enhance the chemical stability of the compositions. A chelating agent may be also desired in the compositions of the present invention as it allows to increase the ionic strength of the compositions herein and thus their stain removal and bleaching performance on various surfaces.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

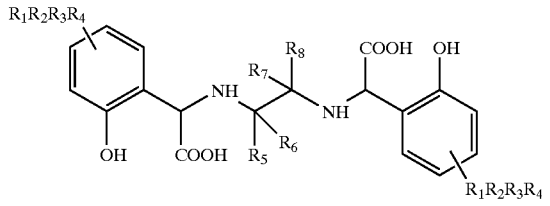

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention comprise up to 5% by weight of the total composition of a chelating agent, or mixtures thereof, preferably from 0.01% to 1.5% by weight and more preferably from 0.01% to 0.5%.

Radical Scavengers

The compositions of the present invention may comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts up to 10% by weight of the total composition and preferably from 0.001% to 0.5% by weight.

The presence of radical scavengers may contribute to the chemical stability of the bleaching compositions of the present invention as well as to the safety profile of the compositions of the present invention.

Suds Controlling Agents

The compositions according to the present invention may further comprise a suds controlling agent such as 2-alkyl alkanol, or mixtures thereof, as a preferred optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the a position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol).

Other suds controlling agents may include alkali metal (e.g., sodium or potassium) fatty acids, or soaps thereof, containing from about 8 to about 24, preferably from about 10 to about 20 carbon atoms.

The fatty acids including those used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process).

Alkali metal soaps can be made by direct saponification of fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% C14, 29% C16, 23% C18, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the term "coconut" is used herein it refers to fatty acid mixtures which typically have an approximate carbon chain length distribution of about 8% C8, 7% C10, 48% C12, 17% C14, 9% C16, 2% C18, 7% oleic, and 2% linoleic (the first six fatty acids listed being saturated). Other sources having similar carbon chain length distribution such as palm kernel oil and babassu oil are included with the term coconut oil.

Other suitable suds controlling agents are exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds controlling agent is advantageously releasably incorporated in a water-soluble or water-dispersible, substantially non-surface-active detergent impermeable carrier. Alternatively the suds controlling agent can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds controlling agents are the self-emulsifying silicone suds controlling agents, described in German Patent Application DTOS 2 646 126 published Apr. 28, 1977. An example of such a compound is DC-544, commercially available from Dow Corning, which is a siloxane-glycol copolymer.

Especially preferred silicone suds controlling agents are described in Copending European Patent application N°. 92201649.8. Said compositions can comprise a silicone/silica mixture in combination with fumed nonporous silica such as Aerosil$^R$.

Especially preferred suds controlling agent are the suds controlling agent system comprising a mixture of silicone oils and the 2-alkyl-alcanols.

Typically, the compositions herein may comprise up to 4% by weight of the total composition of a suds controlling agent, or mixtures thereof, preferably from 0.1% to 1.5% and most preferably from 0.1% to 0.8%.

Stabilisers

The compositions of the present invention may further comprise up to 10%, preferably from 2% to 4% by weight of the total composition of an alcohol according to the formula HO—CR'R"—OH, wherein R' and R" are independently H or a C2–C10 hydrocarbon chain and/or cycle. Preferred alcohol according to that formula is propanediol. Indeed, we have observed that these alcohols in general and propanediol in particular also improve the chemical stability of the compositions.

Other stabilizers like inorganic stabilizers may be used herein. Examples of inorganic stabilizers include sodium stannate and various alkali metal phosphates such as the well-known sodium tripolyphosphates, sodium pyrophosphate and sodium orthophosphate.

Soil Suspending Polymer

The compositions according to the present invention may further comprise a soil suspending polymer, for example a soil suspending polyamine polymer or mixtures thereof, as optional ingredient. Any soil suspending polyamine polymer known to those skilled in the art may be used herein. Particularly suitable polyamine polymers for use herein are polyalkoxylated polyamines. Such materials can conveniently be represented as molecules of the empirical structures with repeating units:

Amine form

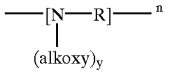

and

Quaternized form

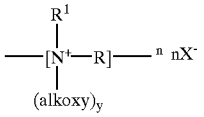

wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula:

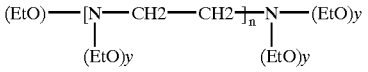

when y=2–30. Particularly preferred for use herein is an ethoxylated polyethylene amine, in particular ethoxylated tetraethylenepentamine, and quatemized ethoxylated hexamethylene diamine.

Soil suspending polyamine polymers contribute to the benefits of the present invention, i.e., that when added on top of said diacyl peroxide, further improve the stain removal performance of a composition comprising them, especially under laundry pretreatment conditions, as described herein. Indeed, they allow to improve the stain removal performance on a variety of stains including greasy stains, enzymatic stains, clay/mud stains as well as on bleachable stains.

Typically, the compositions comprise up to 10% by weight of the total composition of such a soil suspending polyamine polymer or mixtures thereof, preferably from 0.1% to 5% and more preferably from 0.3% to 2%.

The compositions herein may also comprise other polymeric soil release agents known to those skilled in the art. Such polymeric soil release agents are characterised by having both hydrophilic segments, to hydrophilize the surface of hydrophobic fibres, such as polyester and nylon, and hydrophobic segments, to deposit upon hydrophobic fibres and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a co-polymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are fully described in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

If utilised, soil release agents will generally comprise from 0.01% to 10.0%, by weight, of the detergent compositions herein, typically from 0.1% to 5%, preferably from 0.2% to 3.0%.

Dye Transfer Inhibitor

The compositions of the present invention may also include one or more materials effective for inhibiting the transfer of dyes from one dyed surface to another during the cleaning process. Generally, such dye transfer inhibiting agents include polyvinyl pyrrolidone polymers, polyamine N-oxide polymers, co-polymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof. The N—O group can be represented by the following general structures:

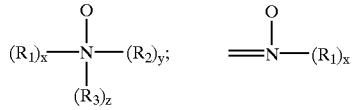

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block co-polymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate co-polymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO". The most preferred polyamine N-oxide useful in the detergent compositions herein is poly(4-vinylpyridine-N-oxide) which as an average molecular weight of about 50,000 and an amine to amine N-oxide ratio of about 1:4.

Co-polymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI co-polymers typically have a molar ratio of N-vinylimidazole to N-vinylpyrrolidone from 1:1 to 0.2:1, more preferably from 0.8:1 to 0.3:1, most preferably from 0.6:1 to 0.4:1. These co-polymers can be either linear or branched.

The present invention compositions may also employ a polyvinylpyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50:1, and more preferably from 3:1 to 10:1.

Suds Booster

If high sudsing is desired, suds boosters such as $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, for example, 0.1%–2%, to provide additional suds and to enhance grease removal performance.

Brightener

Any optical brighteners, fluorescent whitening agents or other brightening or whitening agents known in the art can be incorporated in the instant compositions when they are designed for fabric treatment or laundering, at levels typically from about 0.05% to about 1.2%, by weight, of the detergent compositions herein. Commercial optical brighteners which may be useful in the present invention can be classified into subgroups, which include, but are not necessarily limited to, derivatives of stilbene, pyrazoline, coumarin, carboxylic acids, methinecyanines, dibenzothiophene-5,5-dioxide, azoles, 5- and 6-membered-ring heterocyclic brighteners, this list being illustrative and non-limiting. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM Tinopal PLC; available from Ciba-Geigy; Artic White CC and Artic White CWD, available from Hilton-Davis, located in Italy; the 2-(4-styryl-phenyl)-2H-naphthol[1,2-d] triazoles; 4,4'-bis-(1,2,3-triazol-2-yl)-stil-benes; 4,4'-bis (styryl)bisphenyls; and the aminocoumarins. Specific examples of these brighteners include 4-methyl-7-diethyl-amino coumarin; 1,2-bis(-benzimidazol-2-yl)ethylene; 2,5-bis(benzoxazol-2-yl)thiophene; 2-styryl-napth-[1,2-d] oxazole; and 2-(stilbene-4-yl)-2H-naphtho-[1,2-d]triazole. See also U.S. Pat. No. 3,646,015, issued Feb. 29, 1972, to Hamilton. Anionic brighteners are typically preferred herein.

pH Control Agent

A variety of suitable means can be used for adjusting the pH of the compositions, including organic or inorganic acids, alkanolamines and the like. It may be advantageous to use alkanolamines, in particular monoethanolamine, inasmuch as they have an additional effect of regulating the viscosity of the emulsion, without compromising on its physical stability.

Minor Ingredients

The composition described herein may also comprise minor ingredients such as pigment or dyes and perfumes.

Processes of Treating Surfaces

In the present invention, the liquid aqueous composition of the present invention needs to be contacted with the surface to treat.

By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

By "treating a surface", it is meant herein bleaching and/or disinfecting said surfaces as the compositions of the present invention comprise a bleaching system based of peracid compound or-a mixture thereof and optionally cleaning as said compositions may comprise a surfactant or any other conventional cleaning agents.

Thus, the present invention also encompasses a process of treating, especially bleaching a fabric, as the inanimate surface. In such a process a composition according to the present invention is contacted with the fabrics to be treated.

This can be done either in a so-called "pretreatment mode", where a liquid bleaching composition, as defined herein, is applied neat onto said fabrics before the fabrics are rinsed, or washed then rinsed, or in a "soaking mode" where a liquid bleaching composition, as defined herein, is first diluted in an aqueous bath and the fabrics are immersed and soaked in the bath, before they are rinsed, or in a "through the wash mode", where a liquid bleaching composition, as defined herein, is added on top of a wash liquor formed by dissolution or dispersion of a typical laundry detergent. It is also essential in both cases, that the fabrics be rinsed after they have been contacted with said composition, before said composition has completely dried off.

The processes of bleaching surfaces according to the present invention, especially fabrics, delivers effective whiteness performance as well as effective stain removal performance.

The compositions according to the present invention are preferably contacted to fabrics in a liquid form. Indeed, by "in a liquid form", it is meant herein the liquid compositions according to the present invention per se in neat or in their diluted form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine. Said compositions can be diluted up to 500 times, preferably from 5 to 200 times and more preferably from 10 to 80 times.

More specifically, the process of bleaching fabrics according to the present invention comprises the steps of first contacting said fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted together with the bleaching of said fabrics by contacting said fabrics at the same time with a bleaching composition according to the present invention and said detergent composition, or said washing may be conducted before or after that said fabrics have been bleached. Accordingly, said process according to the present invention allows to bleach fabrics and optionally to wash fabrics with a detergent composition comprising at least one surface active agent before the step of contacting said fabrics with said bleaching composition and/or in the step where said fabrics are contacted with said bleaching composition and/or after the step where said fabrics are contacted with said bleaching composition and before the rinsing step and/or after the rinsing step.

In another embodiment of the present invention the process of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 30 minutes, preferably 1 minute to 10 minutes and then rinsing said fabrics with water. If said fabrics are to be washed, i.e., with a conventional composition comprising at least one surface active agent, said washing may be conducted before or after that said fabrics have been bleached. Advantageously, the present invention provides liquid bleaching compositions that may be applied neat onto a fabric to bleach, despite a standing prejudice against using bleach-containing compositions neat on fabrics while being safe to colors and fabrics perse.

Alternatively instead of following the neat bleaching method as described herein above (pretreater application) by a rinsing step with water and/or a conventional washing step with a liquid or powder conventional detergent, the bleaching pre-treatment operation may also be followed by the diluted bleaching process as described herein before either in bucket (hand operation) or in a washing machine.

It is preferred to perform the bleaching processes herein after said fabrics have been washed with a conventional laundry detergent composition. Indeed, it has been observed that bleaching said fabrics with the compositions according to the present invention (typically diluted bleaching methods) after to washing them with a detergent composition provides superior whiteness and stain removal with less energy and detergent than if said fabrics are bleached first then washed.

In another embodiment the present invention also encompasses a process of treating a hard-surface, as the inanimate surface. In such a process a composition, as defined herein, is contacted with the hard-surfaces to be treated. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form typically up to 200 times their weight of water, preferably into 80 to 2 times their weight of water, and more preferably 60 to 2 times.

When used as hard surfaces bleaching/disinfecting compositions the compositions of the present invention are easy to rinse and provide good shine characteristics on the treated surfaces.

By "hard-surfaces", it is understood any hard-surfaces as mentioned herein before as well as dishes.

Packaging Form of the Liquid Compositions

Depending on the end-use envisioned, the compositions herein can be packaged in a variety of containers including conventional bottles, bottles equipped with roll-on, sponge, brusher or sprayers.

In one embodiment of the present invention the composition is packaged in a two compartment container, wherein the bleaching composition as described herein is packaged in one compartment and a second composition is packaged in the second compartment. In a particularly preferred aspect, the second composition is a conventional heady duty liquid detergent composition, preferably comprising ingredients, particularly bleach-sensitive ingredients such as surfactants, enzymes and perfumes.

The invention is further illustrated by the following examples.

| | Examples | | | | |
|---|---|---|---|---|---|
| Compositions (% weight) | I | II | III | IV | V |
| Na alkylbenzene sulphonate | 2 | 1 | 0.5 | 1.5 | 3 |
| Linear alkyl sulfonate | 2 | 1 | 1 | 0.5 | 1 |
| C12-15 alkyl 7 ethoxylated | — | 1 | 2 | 0.2 | — |
| Akyposoft 100 NV ® | 0.5 | 0.5 | — | 0.3 | 0.4 |
| PAP | 3 | 2 | 4 | 1 | 5 |
| Hydroxy ethane diphosphonate | 0.1 | 0.05 | 0.16 | 0.1 | — |
| di-tert butyl hydroxytoluene | 0.05 | — | — | — | 0.1 |
| Propyl gallate | — | 0.1 | — | 0.05 | — |
| Perfume | — | 0.2 | 0.2 | 0.3 | 0.1 |
| brightener Tinopal PLC | — | 0.01 | 0.05 | 0.03 | — |
| NaOH | — | — | 0.1 | 0.05 | — |
| xanthan gum | — | 0.2 | 0.3 | 0.5 | 0.8 |
| carbopol ETD 2691 | 0.5 | 0.3 | 0.1 | — | 0.2 |
| carbopol ETD 2623 | 0.3 | 0.5 | 0.8 | 1 | — |
| carboxylmethoxycellulose | — | 1 | 0.5 | 1 | 0.8 |
| Alkanizing/acidizing agent up to pH | 3.9 | 2.5 | 3.5 | 4 | 3 |

Akyposoft 100 NV® is a C12–C14 alkyl (ethoxy) 10 carboxylate commercially available from Kao Chemicala Gmbh.

Witkonate NAS 8® is an alkylsulphonate available from Witco AS

BHT is di-tert butyl hydroxy toluene.

HEDP is ethane 1-hydroxy diphosphonate commercially available from Monsanto under the serie Dequest®.

PAP is phthalimidoperoxyhexanoic acid available from Ausimont under the tradename Euroco®

Carbopol®ETD 2623 and 2991 are polymers available from BF Goodrich

Tinopal PLC is available from Ciba-Geigy.

What is claimed is:

1. An aqueous bleaching composition containing from 0.01% to 2.5%, by weight, of a surfactant component consisting of an alkyl ethoxy sulphate surfactant, said bleaching composition comprising:

a) from 0.1% to 40% by weight, of a pre-formed peroxygen bleach having a particle size of less than 100 microns and a solubility in water of from 50 ppm to 800 ppm, said bleach having the formula:

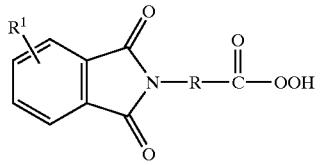

wherein R is $C_1$–$C_{20}$ alkylene; each $R^1$ is hydrogen, alkyl, hydroxyl, nitro, halogen, amine, ammonium, cyano, carboxy, sulphate, sulphonate, and mixtures thereof; and b) the balance carriers and other adjunct ingredients.

2. A composition of matter packaged in a 2-compartment container, wherein the first compartment contains an aqueous bleaching composition comprising:

a) from 10% to 40% by weight, of a pre-formed peroxygen bleach having a particle size of less than 100 microns and a solubility in water of from 50 ppm to 800 ppm, said bleach having the formula:

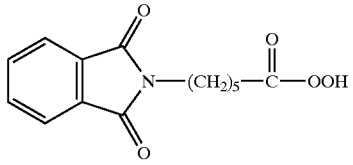

b) from 0.01% to 2.5% by weight, of a surfactant component consisting of an alkyl ethoxy sulphate surfactant;

c) from 0.01% to 1.5% by weight, of a chelant; and d) the balance carriers and other adjunct ingredients; and wherein the second compartment contains a heavy-duty liquid detergent composition.

* * * * *

UNITED STATES PATENT AND TRADEMARK OFFICE

CERTIFICATE OF CORRECTION

PATENT NO. : 6,509,308 B1 
DATED : January 21, 2003
INVENTOR(S) : De Buzzaccarini et al.

It is certified that error appears in the above-identified patent and that said Letters Patent is hereby corrected as shown below:

Title page,
Item [30], Foreign Application Priority Data, "Oct. 11, 1998" should read -- Nov. 11, 1998 --.

Signed and Sealed this

Twenty-seventh Day of May, 2003

JAMES E. ROGAN
*Director of the United States Patent and Trademark Office*